US012540615B2

(12) United States Patent
Waldhoer et al.

(10) Patent No.: US 12,540,615 B2
(45) Date of Patent: Feb. 3, 2026

(54) PUMP FRAME WITH MULTIPLE TIE ROD BOLT PATTERNS

(71) Applicant: GD Energy Products, LLC, Tulsa, OK (US)

(72) Inventors: Timo Waldhoer, Tahlequah, OK (US); Randall Turner Hall, Jr., Claremore, OK (US)

(73) Assignee: GD Energy Products, LLC, Tulsa, OK (US)

( * ) Notice: Subject to any disclaimer, the term of this patent is extended or adjusted under 35 U.S.C. 154(b) by 0 days.

(21) Appl. No.: 18/631,198

(22) Filed: Apr. 10, 2024

(65) Prior Publication Data

US 2025/0320863 A1 Oct. 16, 2025

(51) Int. Cl.
*F04B 53/00* (2006.01)
*F04B 53/16* (2006.01)

(52) U.S. Cl.
CPC ..... *F04B 53/006* (2013.01); *F04B 53/16* (2013.01)

(58) Field of Classification Search
CPC ..... F04B 53/006; F04B 53/16
See application file for complete search history.

(56) References Cited

U.S. PATENT DOCUMENTS 10,184,470 B2 1/2019 Barnett, Jr.
10,781,803 B2 * 9/2020 Kumar ..... F04B 1/0404
10,871,227 B1 * 12/2020 Belshan ..... F04B 1/053
11,162,479 B2 * 11/2021 Thomas ..... F04B 47/00
11,208,996 B2 12/2021 Foster et al.
11,300,111 B2 4/2022 Thomas et al.
11,346,339 B2 5/2022 Nowell et al.
11,359,615 B2 6/2022 Thomas et al.
11,560,884 B2 1/2023 Thomas et al.
11,578,711 B2 2/2023 Thomas et al.
11,635,068 B2 * 4/2023 Foster ..... F16H 57/02 417/313
11,635,151 B2 4/2023 Foster et al.
11,644,018 B2 5/2023 Thomas et al.
11,686,296 B2 6/2023 Son et al.
11,808,254 B2 * 11/2023 Thomas ..... F16K 15/063
11,846,282 B2 * 12/2023 Nowell ..... F04B 53/164
11,859,601 B2 1/2024 Son et al.
11,859,611 B2 1/2024 Thomas et al.
2017/0211565 A1 7/2017 Morreale
2020/0182240 A1 6/2020 Nowell et al.
2022/0389916 A1 12/2022 Keith et al.
2022/0397107 A1 12/2022 Thomas et al.
2023/0003207 A1 1/2023 Foster et al.
(Continued)

OTHER PUBLICATIONS

Notification of International Search Report and Written Opinion including International Search Report and Written Opinion mailed Jul. 25, 2025, 17 pages.

*Primary Examiner* — Jesse S Bogue
(74) *Attorney, Agent, or Firm* — Edell, Shapiro & Finnan, LLC

(57) ABSTRACT

Mounting a fluid end to a power end of a reciprocating pump involves the use of couplers, such as tie rods. A pump frame is structured so that multiple fluid end tie rod patterns can be machined into the nose plate of the power end of the pump. In one embodiment, not all patterns need to exist at the same time, and additional tie rod patterns can be added at a later time for retrofit to other patterns of tie rods.

20 Claims, 11 Drawing Sheets

(56) References Cited

U.S. PATENT DOCUMENTS

| | | | | |
|---|---|---|---|---|
| 2023/0012666 | A1* | 1/2023 | Keith | F04B 53/22 |
| 2023/0047066 | A1 | 2/2023 | Barnett et al. | |
| 2023/0160382 | A1 | 5/2023 | Thomas et al. | |
| 2023/0193887 | A1 | 6/2023 | Thomas et al. | |
| 2023/0258291 | A1 | 8/2023 | Foster et al. | |
| 2023/0272786 | A1 | 8/2023 | Thomas et al. | |
| 2023/0340948 | A1 | 10/2023 | Foster et al. | |
| 2024/0110563 | A1* | 4/2024 | Kay | F04B 53/22 |
| 2025/0154949 | A1* | 5/2025 | Smith | F04B 53/22 |

* cited by examiner

PUMP FRAME WITH MULTIPLE TIE ROD BOLT PATTERNS

FIELD OF INVENTION

The present invention relates to the field of high pressure reciprocating pumps and, in particular, to coupling a fluid end of a high pressure reciprocating pump to a power end of the high pressure reciprocating pump.

BACKGROUND

High pressure reciprocating pumps are often used to deliver high pressure fluids during earth drilling operations. Generally, a reciprocating pump includes a power end and a fluid end. The power end can generate forces sufficient to cause the fluid end to deliver high pressure fluids to earth drilling operations. For example, the power end includes a crankshaft that drives a plurality of reciprocating plungers or pistons near or within the fluid end to pump fluid at high pressure. Thus, the power end must be securely and stably coupled to the fluid end.

Conventional high pressure reciprocating pumps have power end frames that are machined with a single fixed pattern of tie rod holes. In order to adapt to other bolt patterns, an adaptor plate must be designed and installed. The use of an adaptor plate can be costly and difficult to fit on existing equipment.

Thus, there is a need for a high pressure reciprocating pump that can easily be used with multiple patterns and arrangements of tie rods or bolts.

SUMMARY

The present application relates to techniques for mounting a fluid end to a power end. The techniques may be embodied as a pump frame that is structured so that multiple fluid end tie rod patterns can be machined into the nose plate. In one embodiment, not all patterns need to exist at the same time, and additional tie rods can be added at a later time for retrofit to other patterns of tie rods. Additionally, the techniques may be embodied as a method for coupling one or more fluid ends to a power end of a high pressure reciprocating pump.

The present invention incorporates tie rod pattern flexibility into the frame design and eliminates the need for any adaptor plate. The present invention is based on designing a frame so that the nose plate can accommodate multiple fluid end tie rod patterns. As described in detail below, there are two sets of tie rods with different tie rod patterns. Flexibility in the tie rod pattern allows for optimal placement of the tie rods for various fluid end technologies. In one embodiment, the nose plate area may increase in size to have room for all of the tie rod patterns. In addition, the thickness of the nose plate can increase as well to ensure ample engagement with the tie rod threads and to accommodate different oil stop head locations. In other embodiments, the tie rods can be threaded into the main frame rings instead of a thick nose plate.

More specifically, in accordance with at least one embodiment, the present application is directed to a reciprocating pump comprising a power end configured to generate pumping power, the power end including a frame, and a nose plate coupled to the frame, the nose plate including a first set of first openings formed therein, the first set of first openings being configured to receive a first set of couplers that can couple a first fluid end to the power end, and a second set of second openings formed therein, the second set of second openings being configured to receive a second set of couplers that can couple a second fluid end to the power end, wherein the second fluid end is different from the first fluid end, and the first set of first openings is different than the second set of second openings.

In one embodiment, the first set of couplers are tie rods having a first length.

In another embodiment, the second set of couplers are tie rods having a second length, and the second length is different than the first length.

In an alternative embodiment, the nose plate further comprises a third set of third openings configured to receive pony rods of the power end.

In yet another embodiment, the second set of second openings are disposed exteriorly of the third set of third openings.

In another embodiment, the first set of first openings are disposed exteriorly of the second set of second openings.

In an alternative embodiment, each of the first openings has a first diameter, and each of the second openings has a second diameter, the second diameter being larger than the first diameter.

In another embodiment, the first set of first openings is arranged in a first row across the nose plate and in a second row across the nose plate, the second set of second openings is arranged in a third row across the nose plate and in a fourth row across the nose plate.

In yet another embodiment, the first row and the second row are located exteriorly of the third row and the fourth row, respectively.

In another embodiment, each of the first openings and the second openings is a threaded opening.

In accordance with another embodiment, the present application is directed to a reciprocating pump, comprising a power end configured to generate pumping power, the power end including a frame that has a nose plate, the nose plate including a first set of first openings formed therein in a first pattern, the first set of first openings in the nose plate is configured to receive a first set of couplers that can couple a first fluid end to the power end, and a second set of second openings formed therein in a second pattern, the first pattern being different from the second pattern, the second set of second openings in the nose plate is configured to receive a second set of couplers that can couple a second fluid end to the power end, wherein the second fluid end is different from the first fluid end.

In one embodiment, each of the first set of couplers and the second set of couplers is a tie rod.

In an alternative embodiment, the nose plate includes a third set of third openings configured to receive pony rods of the power end.

In another embodiment, the first set of first openings are disposed exteriorly of the third set of third openings, and the second set of second openings are disposed interiorly of the first set of first openings.

In yet another embodiment, the first set of first openings is arranged in a first row and in a second row across the nose plate, the second set of second openings is arranged in a third row and in a fourth row across the nose plate, and the second openings are different from the first openings.

In an alternative embodiment, the first row and the second row are located exteriorly of the third row and the fourth row.

In another embodiment, each of the first openings and the second openings is a threaded opening.

In accordance with another embodiment, the present application is directed to a power end for a reciprocating pump, the power end comprising a frame having a nose plate that has a body, the body of the nose plate including a first set of first openings extending through the body of the nose plate and being disposed in a first pattern, the first set of first openings configured to receive first couplers that are configured to couple a first fluid end to the nose plate, and a second set of second openings extending through the body of the nose plate and being disposed in a second pattern, the second set of second openings configured to receive second tie rods that are configured to couple a second fluid end to the nose plate, wherein the second pattern is different from the first pattern, the second fluid end engages a different pattern of couplers than the first fluid end, and the second couplers are different than the first couplers.

In one embodiment, the first set of first openings is arranged in a first row across the nose plate and in a second row across the nose plate, the second set of second openings is arranged in a third row across the nose plate and in a fourth row across the nose plate, and the second openings are different from the first openings.

In another embodiment, the first row and the second row are located exteriorly of the third row and the fourth row, respectively.

The foregoing advantages and features will become evident in view of the drawings and detailed description.

BRIEF DESCRIPTION OF THE DRAWINGS

To complete the description and in order to provide for a better understanding of the present application, a set of drawings is provided. The drawings form an integral part of the description and illustrate embodiments of the present application, which should not be interpreted as restricting the scope of the invention, but just as examples. The drawings comprise the following figures.

Like reference numerals have been used to identify like elements throughout this disclosure.

DETAILED DESCRIPTION

The following description is not to be taken in a limiting sense but is given solely for the purpose of describing the broad principles of the invention. Embodiments of the invention will be described by way of example, with reference to the above-mentioned drawings showing elements and results according to the present invention.

In one aspect of the disclosure, the present application relates to techniques for mounting a fluid end to a power end. In one implementation, the techniques may be a pump frame that is structured so that multiple fluid end tie rod patterns can be machined into the nose plate. In one embodiment, multiple sets of holes into which tie rods are connected are machined into the nose plate. Additional tie rod hole patterns can be added to the nose plate at a later time.

The present invention relates to a nose plate that can accommodate multiple fluid end tie rod patterns. In one embodiment, two sets of tie rods with different tie rod patterns are utilized. Flexibility in the tie rod pattern allows for optimal placement of the tie rods for various fluid end technologies. In different embodiments, the nose plate area may increase in size and/or the thickness of the nose plate may increase as well to accommodate different tie rod patterns.

Figure 1:
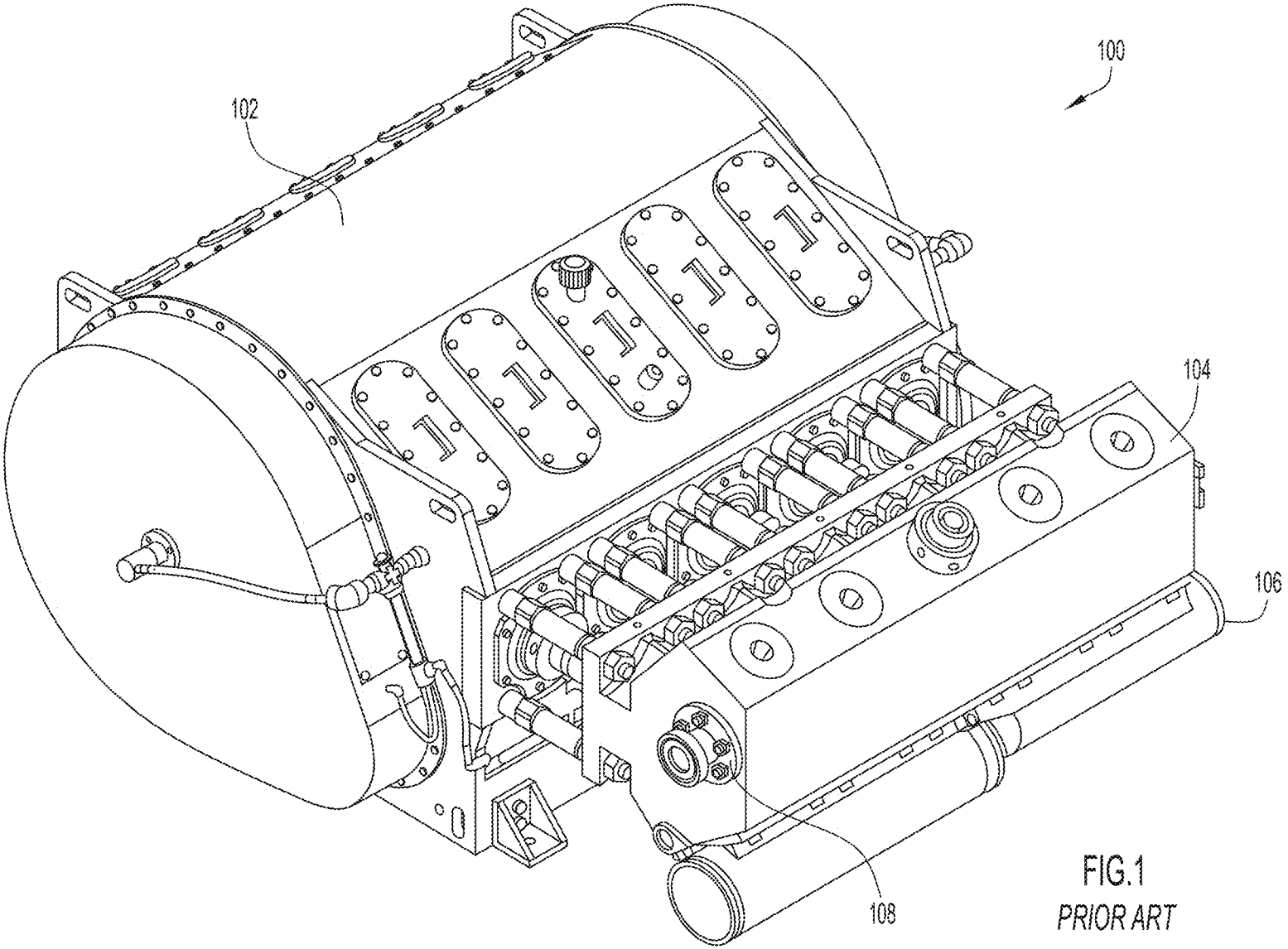
FIG.1 PRIOR ART
FIG. 1 is a front perspective view of a prior art reciprocating pump including a fluid end and a power end.

Referring to FIG. 1, a prior art reciprocating pump 100 is illustrated. The reciprocating pump 100 includes a power end 102 and a fluid end 104. The power end 102 includes a crankshaft 103 that drives a plurality of reciprocating plungers or pistons (generally referred to as "reciprocating elements") within the fluid end 104 to pump fluid at high pressure (e.g., to cause the fluid end 104 to deliver high pressure fluids to earth drilling operations). For example, the power end 102 may be configured to support hydraulic fracturing (i.e., fracking) operations, where fracking liquid (e.g., a mixture of water and sand) is injected into rock formations at high pressures to allow natural oil and gas to be extracted from the rock formations. However, to be clear, this example is not intended to be limiting and the present application may be applicable to both fracking and drilling operations. At the same time, the present invention may also offer some specific advantages for hydraulic fracturing, which may be noted herein where applicable.

In any case, often, the reciprocating pump 100 may be quite large and may, for example, be supported by a semi-tractor truck ("semi") that can move the reciprocating pump 100 to and from a well. Specifically, in some instances, a semi may move the reciprocating pump 100 off a well when the reciprocating pump 100 requires maintenance. However, a reciprocating pump 100 is typically moved off a well only when a replacement pump (and an associated semi) is available to move into place at the well, which may be rare. Thus, often, the reciprocating pump is taken offline at a well and maintenance is performed while the reciprocating pump 100 remains on the well. If not for this maintenance, the reciprocating pump 100 could operate continuously to extract natural oil and gas (or conduct any other operation). Consequently, any improvements that extend the lifespan of components of the reciprocating pump 100, extend the time between maintenance operations (i.e., between downtime), and/or minimize the time needed to complete maintenance operations (minimizing downtime) are highly desirable.

Figure 2A:
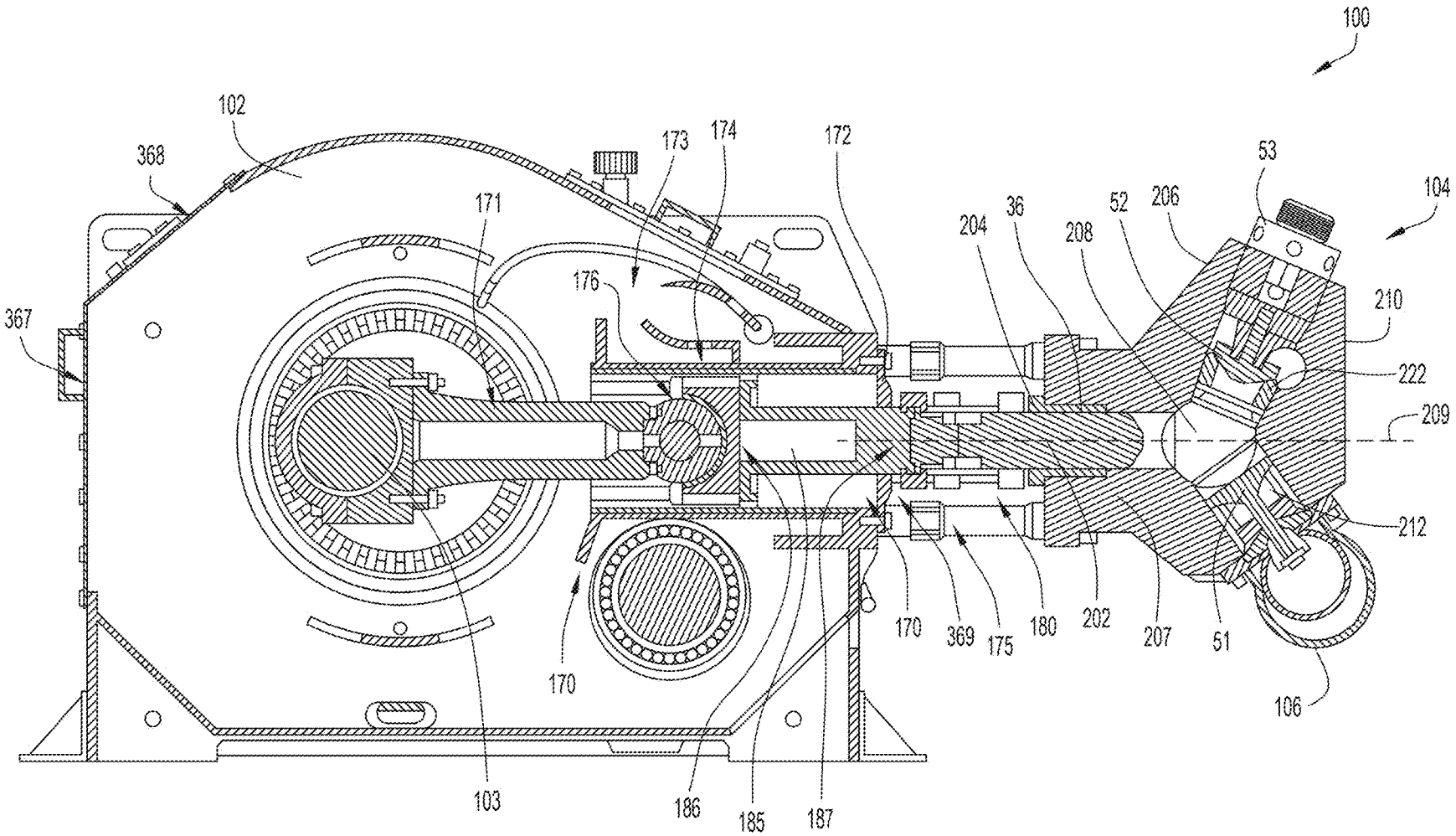
FIG.2A PRIOR ART
FIG. 2A is a side cross-sectional view of the prior art reciprocating pump of FIG. 1.

Still referring to FIG. 1, but now in combination with FIG. 2A, the reciprocating pump 100 pumps fluid into and out of pumping chambers 208. FIG. 2A shows a side, cross-sectional view of reciprocating pump 100 taken along a central axis 209 of one of the reciprocating elements 202 included in reciprocating pump 100. Thus, FIG. 2A depicts a single pumping chamber 208. However, it should be understood that a fluid end 104 can include multiple pumping chambers 208 arranged side-by-side. In fact, in at least some embodiments (e.g., the embodiment of FIG. 1), a casing 206 of the fluid end 104 forms a plurality of pumping chambers 208 and each chamber 208 includes a reciprocating element 202 that reciprocates within the casing 206. However, side-by-side pumping chambers 208 need not be defined by a single casing 206. For example, in some embodiments, the fluid end 104 may be modular and different casing segments may house one or more pumping chambers 208. In any case, the one or more pumping chambers 208 are arranged side-by-side so that corresponding conduits are positioned adjacent each other and generate substantially parallel pumping action. Specifically, with each stroke of the reciprocating element 202, low pressure fluid is drawn into the pumping chamber 208 and high pressure fluid is discharged. But, often, the fluid within the pumping chamber 208 contains abrasive material (i.e., "debris") that can damage seals formed in the reciprocating pump 100, such as the "packing seals" surrounding a reciprocating element 202 of a fracking fluid end, creating a need for continued maintenance.

In various embodiments, the fluid end 104 may be shaped differently and/or have different features, but may still generally perform the same functions, define similar structures, and house similar components. For example, while fluid end 104 includes a first bore 204 that intersects an inlet bore 212 and an outlet bore 222 at skewed angles, other fluid ends may include any number of bores arranged along any desired angle or angles, for example, to intersect bore 204 (and/or an access bore) substantially orthogonally and/or so that two or more bores are substantially coaxial. Generally, bores 212 and 222, as well as any other bores (i.e., segments, conduits, etc.), may intersect to form a pumping chamber 208, may be cylindrical or non-cylindrical, and may define openings at an external surface 210 of the casing 206. Additionally, bores 212 and 222, as well as any other bores (i.e., segments, conduits, etc.), may receive various components or structures, such as sealing assemblies or components thereof.

In the illustrated embodiment, inlet bore 212 defines a fluid path through the fluid end 104 that connects the pumping chamber to a piping system 106 delivering fluid to the fluid end 104. Meanwhile, outlet bore 222 allows compressed fluid to exit the fluid end 104. Thus, in operation, bores 212 and 222 may include valve components 51 and 52, respectively, (e.g., one-way valves) that allow bores 212 and 222 to selectively open and deliver a fluid through the fluid end 104. Typically, valve components 51 in the inlet bore 212 may be secured therein by a piping system 106 (see FIG. 1). Meanwhile valve components 52 in outlet bore 222 may be secured therein by a closure assembly 53 that, in the prior art example illustrated in FIG. 2A, is removably coupled to the fluid end 104 via threads.

In operation, fluid may enter fluid end 104 via outer openings of inlet bores 212 and exit fluid end 104 via outer openings of outlet bores 222. More specifically, fluid may enter inlet bores 212 via pipes of piping system 106, flow through pumping chamber 208 (due to reciprocation of reciprocating elements 202), and then flow through outlet bores 222 into a channel 108 (see FIG. 1). However, piping system 106 and channel 108 are merely example conduits and, in various embodiments, fluid end 104 may receive and discharge fluid via any number of pipes and/or conduits, along pathways of any desirable size or shape.

Meanwhile, each of bores 204 defines, at least in part, a cylinder for one of the reciprocating elements 202, and/or connects the casing 206 to a cylinder for reciprocating elements 202. More specifically, in the illustrated embodiment, a casing segment 207 houses a packing assembly 36 configured to seal against a reciprocating element 202 disposed interiorly of the packing assembly 36. Reciprocation of a reciprocating element 202 in or adjacent to bore 204, which may be referred to as a reciprocation bore (or, for fracking applications, a plunger bore), draws fluid into the pumping chamber 208 via inlet bore 212 and pumps the fluid out of the pumping chamber 208 via outlet bore 222. However, over time, the packing assembly 36 will wear and/or fail, and thus, must be accessed for maintenance and/or replacement. Other components, such as valve components 51 and/or 52, or the fluid end casing 206 itself may also wear and/or fail and require repair or replacement over time. To help provide access to these parts and/or the pumping chamber, some fluid ends have access bores that are often aligned with (and sometimes coaxial with) the reciprocating bore 204. Other fluid ends needs not include access bore and, thus, such an access bore is not illustrated in FIGS. 1 and 2A.

Regardless of whether the fluid end includes an access bore, the packing assembly 36 typically needs to be replaced from an outer opening of bore 204 (i.e., a side of bore 204 aligned with the external surface 210 of the casing 206). At the same time, to operate properly, the fluid end 104 must be securely and stably coupled to the power end 102. Thus, often, with prior art reciprocating pumps like reciprocating pump 100, the fluid end 104 is directly coupled to the power end 102 with relatively short couplers 175 and at least a portion of the reciprocating pump 100 must be disassembled to access bore 204, e.g., to replace packing assembly 36.

Figure 2B:
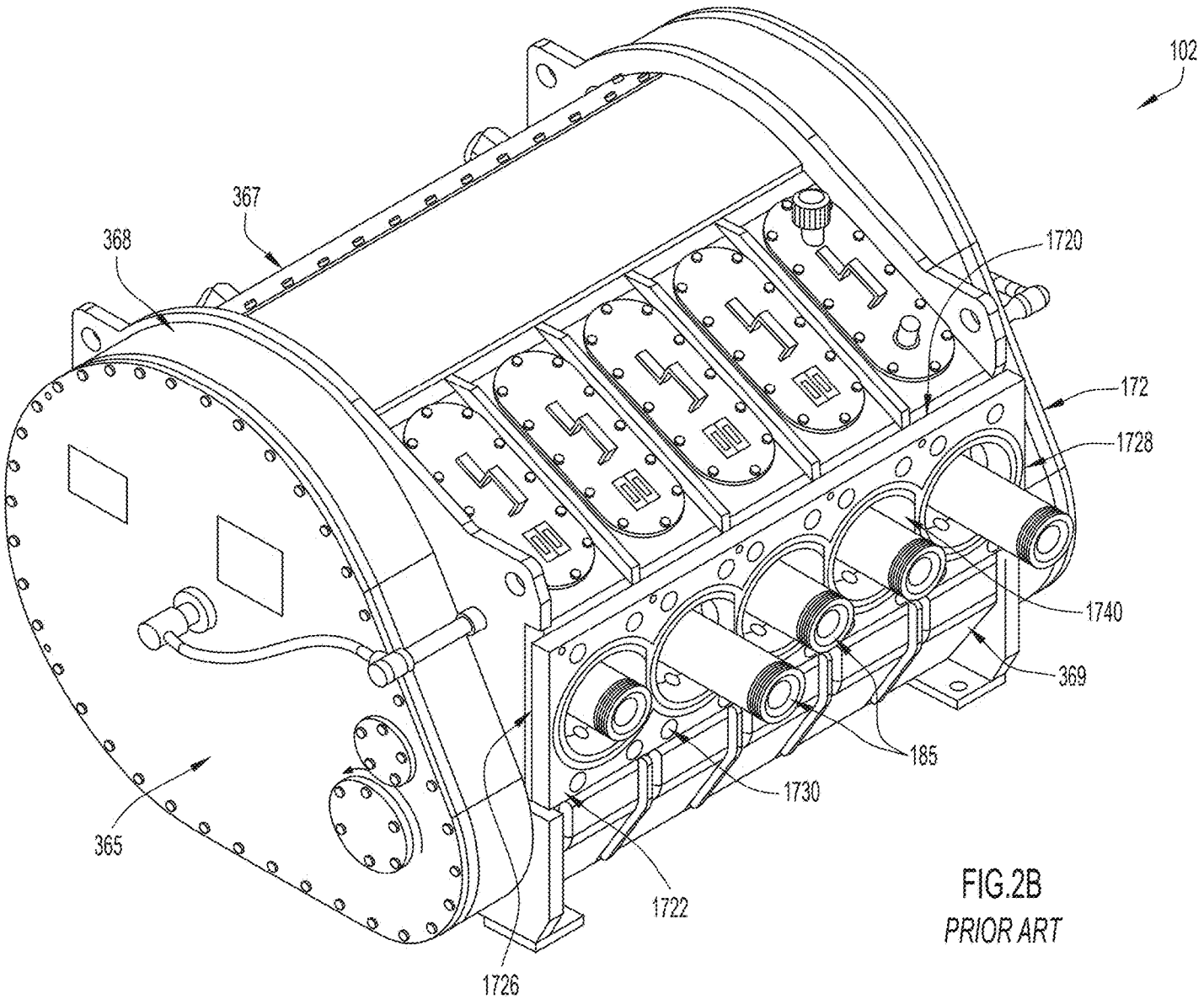
FIG.2B PRIOR ART
FIG. 2B is a front perspective view of the prior art power end of FIG. 1.

Now turning to FIGS. 2A and 2B, in the illustrated prior art reciprocating pump 100, couplers 175 (e.g., tie rods, which are sometimes referred to as stay rods) are threaded to a nose plate 172 of a crosshead assembly 170 of the power end 102 to position the fluid end 104 in close proximity to the power end 102. This limits the overall size of the cradle 180 (i.e., the space between the fluid end 104 and the power end 102, in which a plunger or piston may reciprocate), while also limiting the amount of open space available in the cradle 180. Thus, the power end 102 might need to be fully disconnected from the fluid end 104 to create the space needed to service the fluid end 104. But, at the same time, repeatedly connecting and disconnecting the threaded couplers 175 and the nose plate 172 (or from threaded couplers formed on any other fixed or irremovably portion of a power end) may strip the couplers 175 and require replacement of couplers 175.

Moreover, since couplers 175 connect directly to the nose plate 172, the power end 102 may only be able to operate with fluid ends specifically designed to receive couplers 175 in the arrangement dictated by nose plate 172. In the prior art power end 102, this nose plate is welded or otherwise irremovably coupled to a crosshead frame 174 of a crosshead assembly 170 of the power end 102. That is, the nose plate 172 is integrated into or formed with the power end 102. Thus, the power end 102 may only be operable with fluid ends that include coupling features that match the orientation of coupling features included on nose plate 172. At the same time, the position of the nose plate 172 is not adjustable or manipulable because the irremovable connection/integration of the nose plate 172 into the power end 102 allows the nose plate 172 to withstand extremely high stresses imparted thereto during generation of pumping power by the power end 102. That said, in other prior art power ends, couplers 175 might connect directly into another part of portion of a power end that is able to withstand these high stresses (e.g., into a frame portion), but these coupling points are typically fixed on and/or irremovable from the power end 102. Either way, a power end 102 that directly receives couplers connecting the power end 102 to a fluid end 104 may have limited compatibility across different fluid ends.

More specifically, with the prior art power end 102, the locations at which a fluid end 104 may be coupled to the power end 102 are fixed and/or preset by a set of receptacles 1730. In this particular prior art power end 102, the nose plate 172 defines the locations of receptacles 1730 for the power end 102 (which is positioned at and/or generally defines a front of the power end 102). However, in other embodiments, receptacles 1730 could be included in any part or portion of a power end. That is, the power end 102 may include a frame 368 that extends from a front 369 to a back 367 and the receptacles 1730 may generally be included in the front 369 of frame 368. Receptacles 1730 can be seen clearly in FIG. 2B, which shows the power end 102 disconnected from the fluid end 104, e.g., during maintenance of the packing assembly 36 included in the fluid end 104. FIG. 2B also clearly shows how, in this particular embodiment, the nose plate 172 extends from a first end 1726 to a second end 1728 and also extends from a back surface 1720 to a front surface 1722.

Generally, in prior art power ends that include a nose plate 172, the nose plate 172 is installed or formed in the power end 102 by forming the nose plate 172 with the frame 368, irremovably welding the nose plate 172 to the frame 368, or otherwise irremovably coupling the nose plate 172 to the frame 368. Once installed, the first end 1726 of the nose plate 172 is positioned proximate a first side 365 of the frame 368 of the power end 102 (e.g., aligned with a housing for a main roller and pinion) and the second end 1728 of the nose plate 172 is positioned proximate a second side (opposite the first side 365) of the frame 368 (e.g., aligned with a housing for a main roller and pinion). Meanwhile, the back surface 1720 of the nose plate 172 faces and/or defines the front 369 of frame 368. In fact, in some instances, the nose plate 172 encloses a crosshead frame 174 of the crosshead assembly 170 (but does not necessarily do so in all power ends).

In the illustrated embodiment, the receptacles 1730 extend into the nose plate 172 from the front surface 1722 and are generally disposed around pony rod holes 1740. However, in other embodiments, the receptacles 1730 need not be positioned as such. In any case, the receptacles 1730 may be threaded so that a threaded coupler 175 can be secured directly therein. Still further, in some instances, receptacles 1730 need not extend through back surface 1720, which may prevent couplers 175 from extending into the crosshead assembly 170 and interfering with operations of the crosshead assembly 170 and/or allowing contaminants into the crosshead assembly 170. However, other embodiments might include receptacles 1730 that are through holes.

Still referring to FIGS. 2A and 2B, in the prior art reciprocating pump 100—and in most high pressure reciprocating pumps—the crosshead frame 174 is a part of a crosshead assembly 170 that converts rotational motion of the crankshaft 103 into linear, reciprocating motion of a pony rod 185. More specifically, the crosshead assembly 170 includes a connecting rod 171, a crosshead 173, and a pony rod 185. The crosshead 173 includes a connector 176 disposed within a crosshead frame 174 and the connecting rod 171 extends from the crankshaft 103 to the connector 176. The connector 176 is configured to move linearly within the crosshead frame 174 and opposite ends of the connecting rod 171 are configured to travel with the crankshaft 103 and the connector 176.

Thus, as the connecting rod 171 rotates with the crankshaft 103, it reciprocates the connector 176 within the crosshead frame 174. The connector 176 is also connected to a back side 186 of the pony rod 185 so that the pony rod 185 reciprocates with the connector 176. Meanwhile, a front side 187 of the pony rod 185 can be coupled to a reciprocating element 202 (e.g., a plunger), such as via a clamp, to drive reciprocating motion of the reciprocating element 202 that pumps fluid through the fluid end 104. Notably, during this action, the pony rod 185 and/or the crosshead 173 exert forces on the front 369 of the frame 368, which in the specific embodiment illustrated in FIGS. 2A and 2B, is defined, at least in part, by nose plate 172. These forces stress the frame 368 and/or the nose plate 172 (and potentially the crosshead frame 174). Thus, as mentioned, in embodiments where a nose plate 172 defines at least a portion of the front 369 of frame 368, the nose plate 172 is usually irremovably coupled to the crosshead frame 174 to remain structurally sound during operation of the reciprocating pump 100. Additionally or alternatively, a front 369 of frame 368 may be irremovably coupled to other portions of an overall frame for the power end 102.

Figure 3:
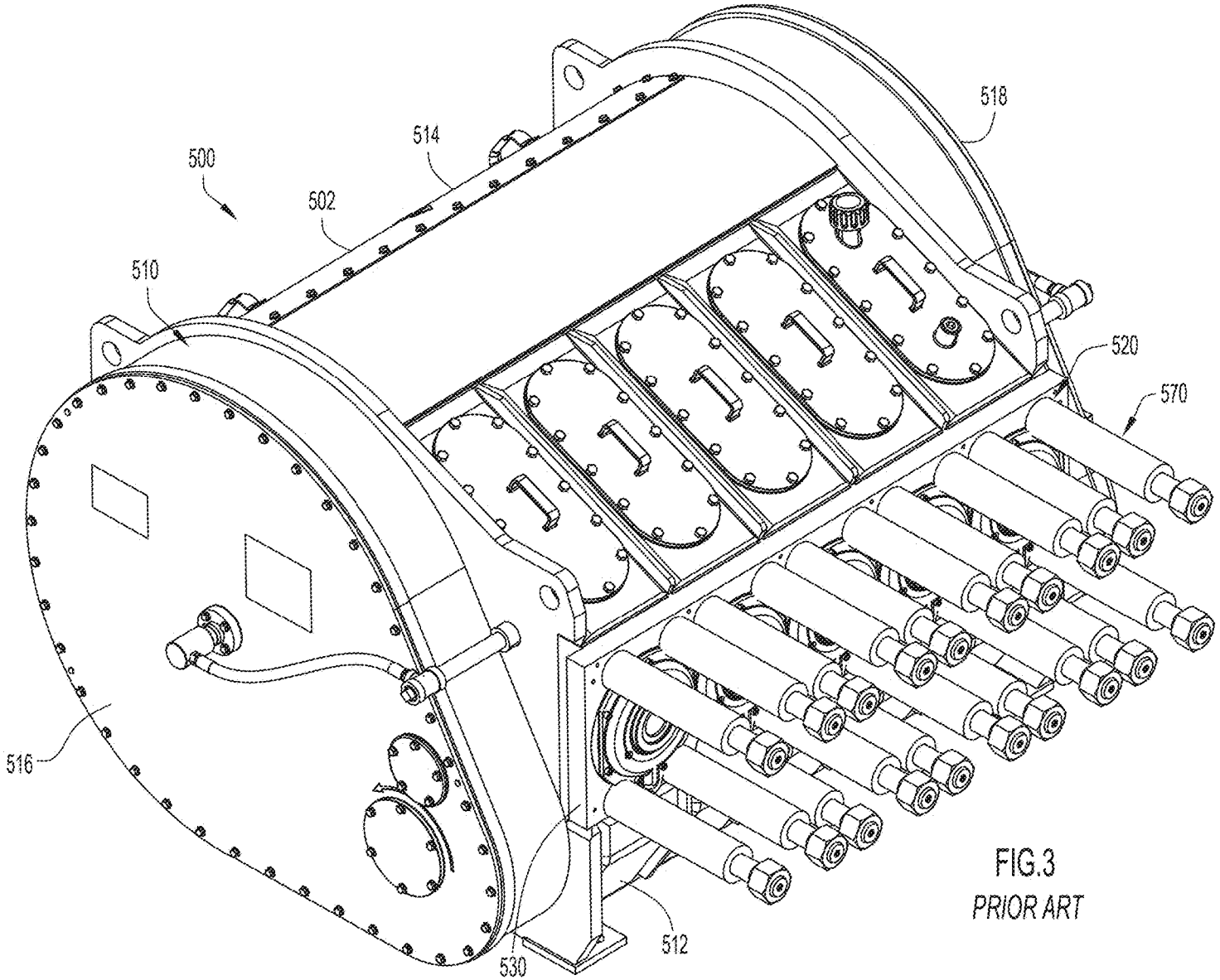
FIG.3 PRIOR ART
FIG. 3 is a front perspective view of another embodiment of a power end for a prior art reciprocating pump with tie rods connected thereto.
Figure 4:
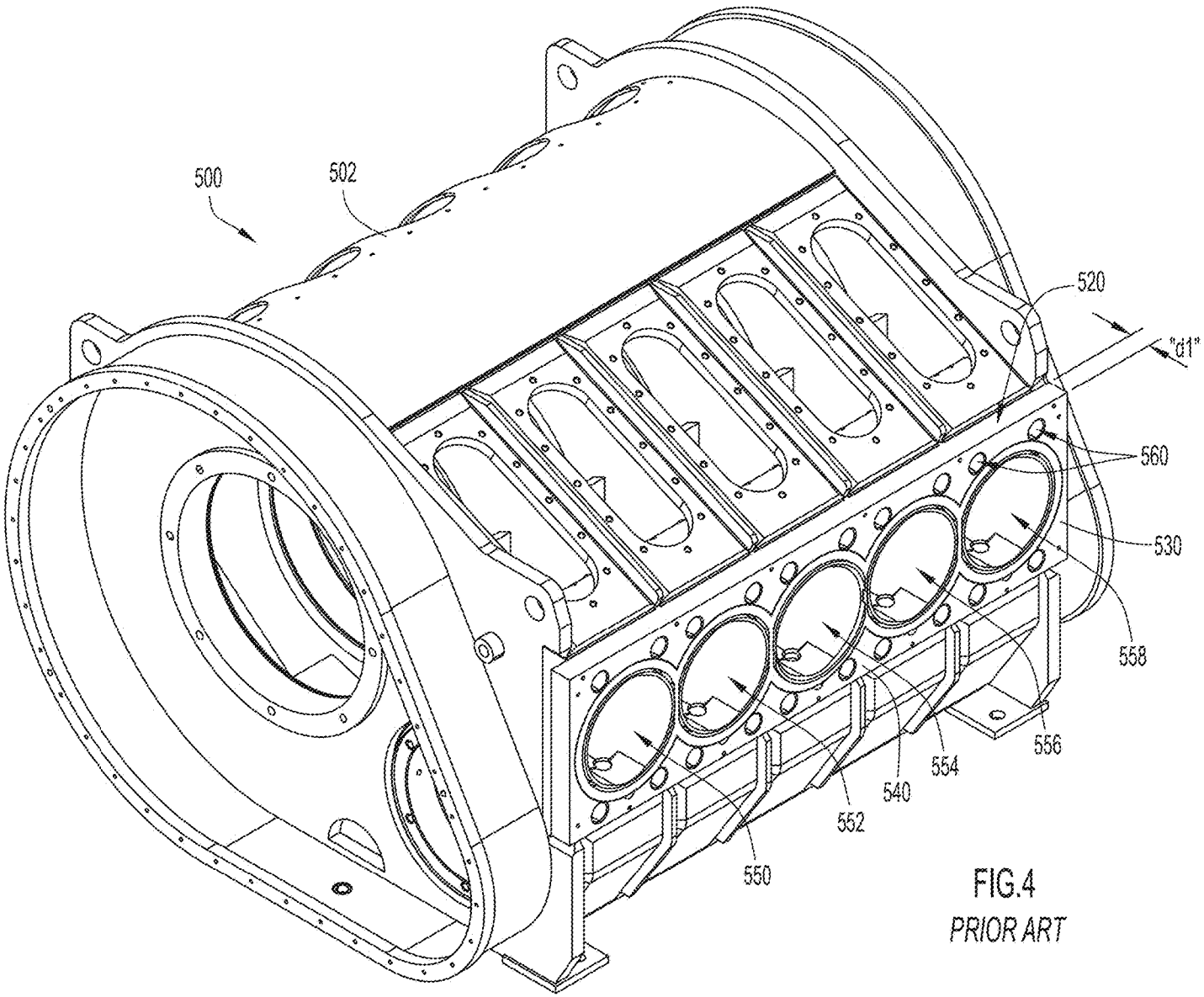
FIG.4 PRIOR ART
FIG. 4 is a front perspective view of the prior art power end illustrated in FIG. 3 with the tie rods removed.

Now turning to FIGS. 3 and 4, another embodiment of a power end of a prior art reciprocating pump is illustrated. In this embodiment, the reciprocating pump 500 includes a power end 502 to which a fluid end (not shown) can be coupled. The power end 502 includes a frame 510 with a nose plate 520. The frame 510 includes a front 512, a back 514, and opposite sides 516 and 518. The nose plate 520 has a body 530 with a front surface 540. Mounted to the nose plate 520 are several tie rods 570 that are used to couple the fluid end to the power end 502. The tie rods 570 are disposed in a pattern around the nose plate 520.

Referring to FIG. 4, the nose plate 520 has a front surface and an opposite back surface that define a thickness "d1" therebetween. In this view, the tie rods 570 have been removed from the nose plate 520. The body 530 of the nose plate 520 has several reciprocating member holes 550, 552, 554, 556, and 558 in which reciprocating members, such as a pony rods, may be located. Disposed around holes 550, 552, 554, 556, and 558 are coupler holes 560. In one embodiment, the coupler holes 560 are threaded and configured to receive couplers, such as tie rods 570.

A limitation with power end 502 is that it only allows has a single fixed tie rod mounting pattern for mounting a fluid end. To accommodate different fluid ends that have different tie rod connecting patterns, an adapter plate is needed between the power end and the fluid end.

Now turning to FIGS. 5-10, the present application improves the compatibility and serviceability of a reciprocating pump by providing the ability to couple different fluid ends to the power end of the reciprocating pump. In this embodiment, reciprocating pump 700 includes a power end 702 that has a frame mounting interface that has been optimized for additional tie rod patterns. As described in detail below, the power end 702 allows the mounting of multiple alternative fluid ends to the power end 702 with adaptive and selective tie rod patterns.

In this embodiment, the power end 702 has a frame 710 with a nose plate 720 which is the front of the frame 710. The nose plate 720 includes a body 730 with a front surface 740 and a back surface 742 opposite the front surface 740. The body 730 has a thickness "d2" as defined between the front surface 740 and the back surface 742. Thickness "d2" is larger than thickness "d1" of nose plate 520 illustrated in FIG. 4.

The nose plate 720 of reciprocating pump 700 provides multiple options for connecting different fluid ends to the power end 702. The different fluid ends may be mounted or coupled to the power end via different sets of couplers, which may vary in terms of quantity, locations, lengths, and widths. In one embodiment, the couplers are tie rods that are threaded into openings formed in the body 730 of the nose plate 720. The openings can be referred to alternatively as holes.

According to the aspects of this disclosure, the body 730 of the nose plate 720 has multiple sets of openings formed therein to which couplers, such as tie rods or tie rod bolts, can be connected. One set of openings in the body 730 is configured to have a first set 750 of couplers mounted thereto. Another set of openings in the body 730 is configured to have a second set 760 of couplers mounted thereto. The result of the different sets of openings is that a first set 750 of couplers is arranged in a first pattern, and a second set 760 of couplers are arranged in a second pattern, which is different from the first pattern. The desired one of the first pattern or the second pattern to be used in an application depends on the particular arrangement of the corresponding through holes formed in the fluid end to be coupled to the power end 702.

Figure 5:
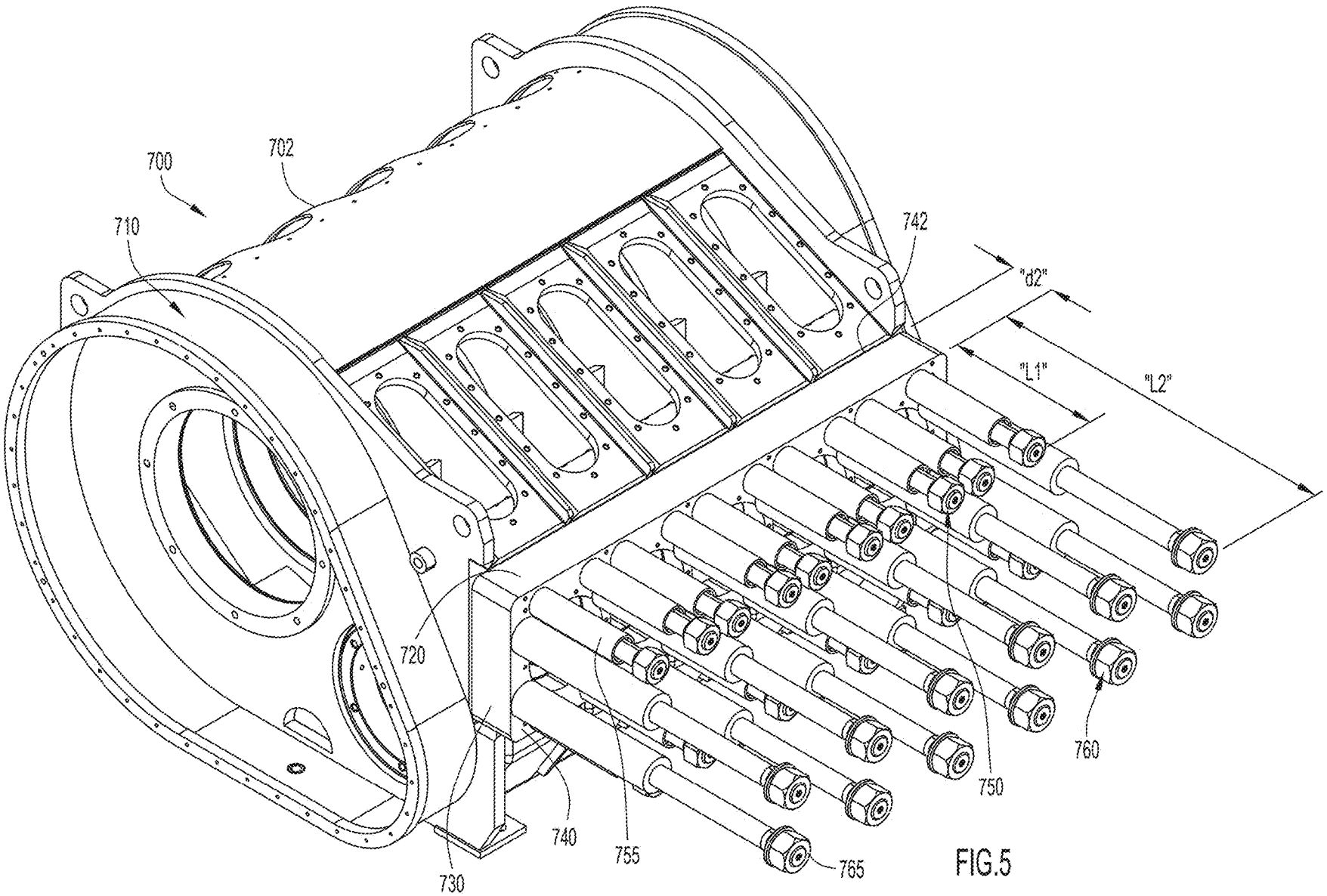
FIG. 5 is a front perspective view of a reciprocating pump with two sets of tie rods, according to an example embodiment of the present application.

As shown in FIG. 5, the first set 750 of couplers includes several couplers 755 located in a first pattern and having a first length "L1." In addition, the second set 760 of couplers includes several couplers 765 located in a second pattern and having a second length "L2." In this embodiment, the second length "L2" is greater than the first length "L1." Notably, the particular one of the first set 750 of couplers or the second set 760 of couplers to be used with power end 702 depends on which combination of the coupler pattern, the coupler length, and the coupler width or diameter meets what is needed for the desired fluid end.

Figure 6:
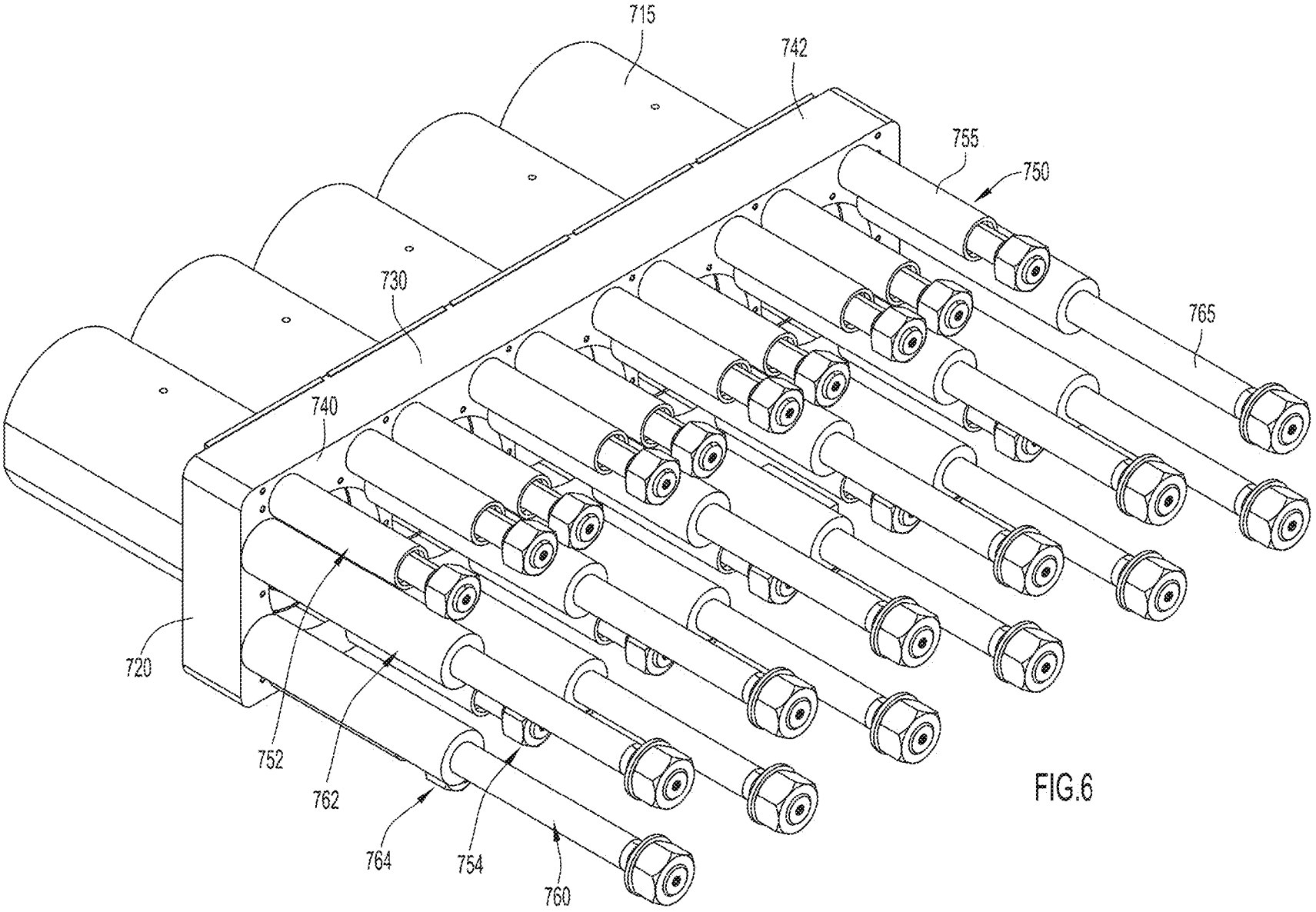
FIG. 6 is a front perspective view of a portion of the reciprocating pump illustrated in FIG. 5 with two sets of tie rods connected thereto.

Referring to FIG. 6, the nose plate 720 is removed from the rest of the frame 710. Shown with the nose plate 720 are reciprocating member cylinders 715 located on the back surface 742 of the body 730. When the first set 750 of couplers is used with nose plate 720, the couplers 755 of the first set 750 of couplers are arranged in two different rows across the nose plate 720. In particular, the couplers 755 can be located in row 752 and in row 754. Similarly, when the second set 760 of couplers are used with nose plate 720, the couplers 765 of the second set 760 of couplers are arranged in two different rows across the nose plate 720. In particular, the couplers 765 can be located in row 762 and row 764. As described in detail below, rows 752 and 754 are located outside or exteriorly of rows 762 and 764. The locations of the rows can be described alternatively as row 752 being outward of or above row 762, and row 754 below outward of or below row 764.

Figure 7:
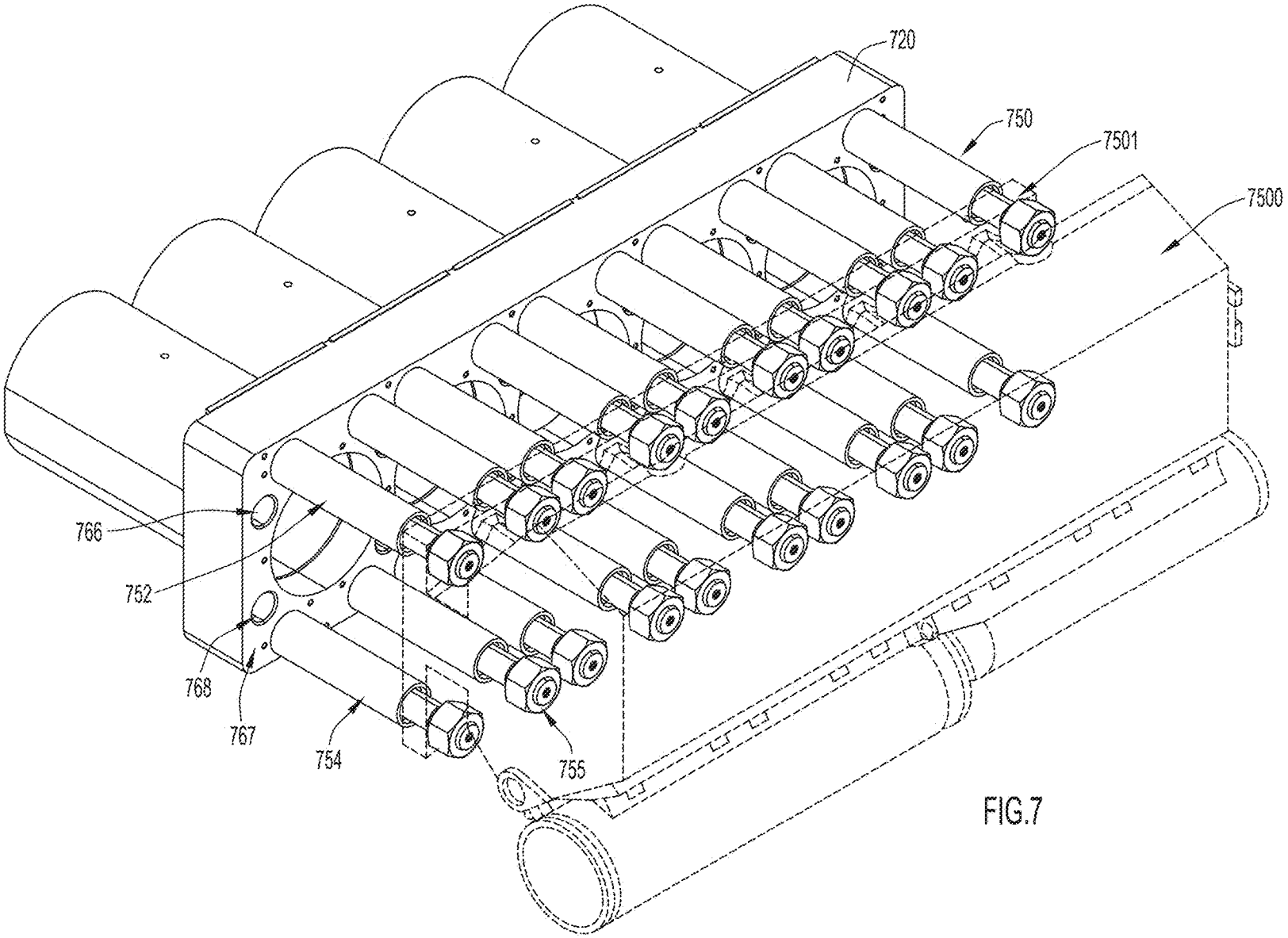
FIG. 7 is a front perspective view of the portion of the reciprocating pump illustrated in FIG. 6 with a first set of tie rods connected thereto.

Turning to FIG. 7, only the first set 750 of couplers is illustrated as being coupled to the nose plate 720 and extending to a flange 7501 of a fluid end 7500, thereby coupling the couplers to a proximate face of fluid end 7500. The couplers 755 in the first set 750 of couplers are located in upper row 752 and in lower row 754. In this view, some of the second pattern 767 of coupler holes are shown. The second pattern 767 of coupler holes includes an upper row 766 of coupler holes and a lower row 768 of coupler holes. In this use of the nose plate 720, the first set 750 of couplers is being used with couplers 755. The second pattern 767 can be machined at the initial manufacturing of the nose plate 720, or subsequently machined in the nose plate 720 based on demand.

Figure 8:
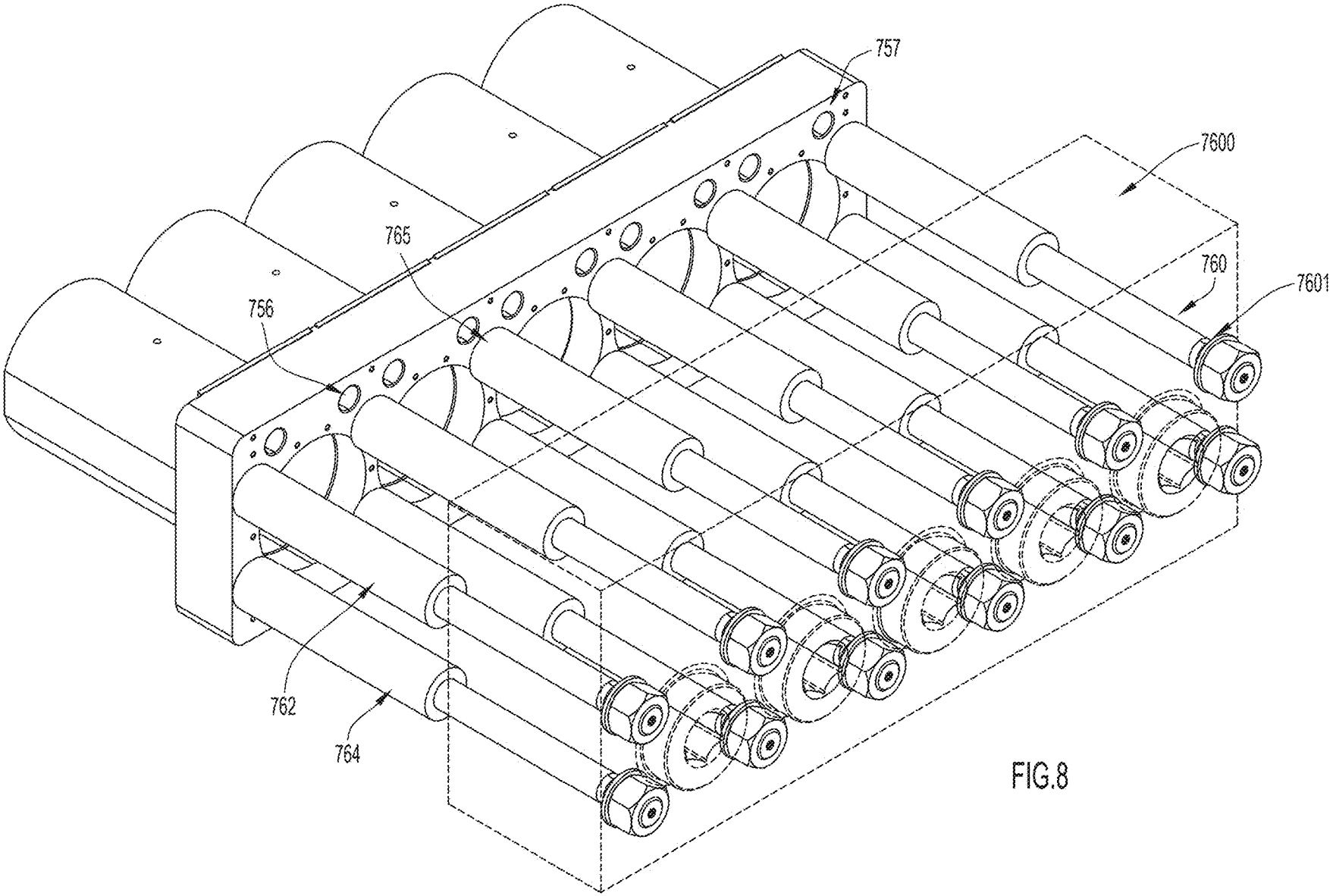
FIG. 8 is a front perspective view of the portion of the reciprocating pump illustrated in FIG. 6 with a second set of tie rods connected thereto.

Turning to FIG. 8, only the second set 760 of couplers is illustrated as being coupled to the nose plate 720 and extending through holes 7601 of a fluid end 7600, thereby coupling the couplers to a distal face of fluid end 7600. The couplers 765 in the second set 760 of couplers are located in an upper row 762 and in a lower row 764. In this view, some of the first pattern 757 of coupler holes are shown, namely, upper row 756 of coupler holes. In this use of the nose plate 720, the second set 760 of couplers is being used with couplers 765. The first pattern 757 can be machined at the initial manufacturing of the nose plate 720, or subsequently machined in the nose plate 720 based on demand.

Figure 9:
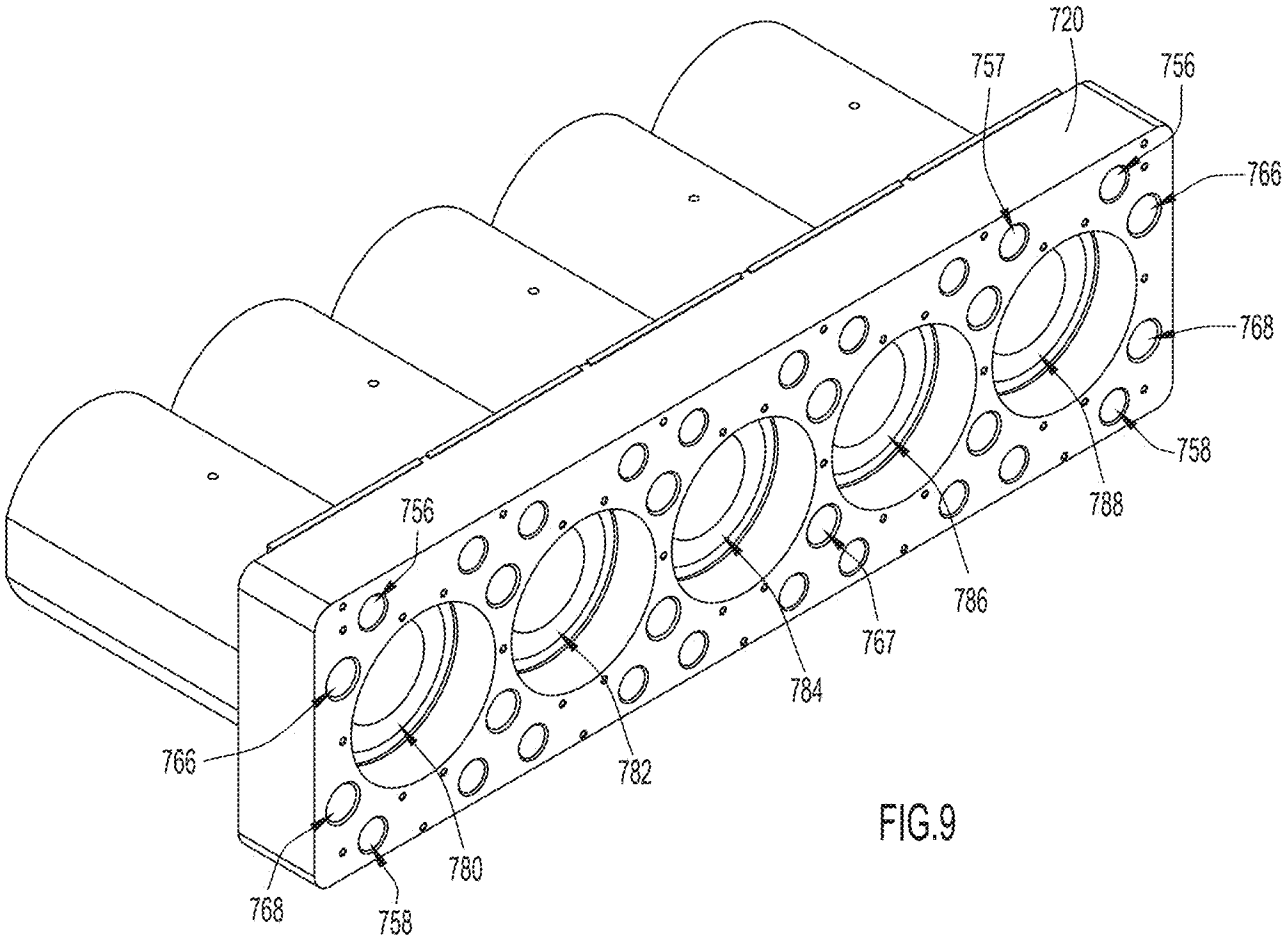
FIG. 9 is a front perspective view of the portion of the reciprocating pump illustrated in FIG. 6 with no tie rods connected thereto.
Figure 10:
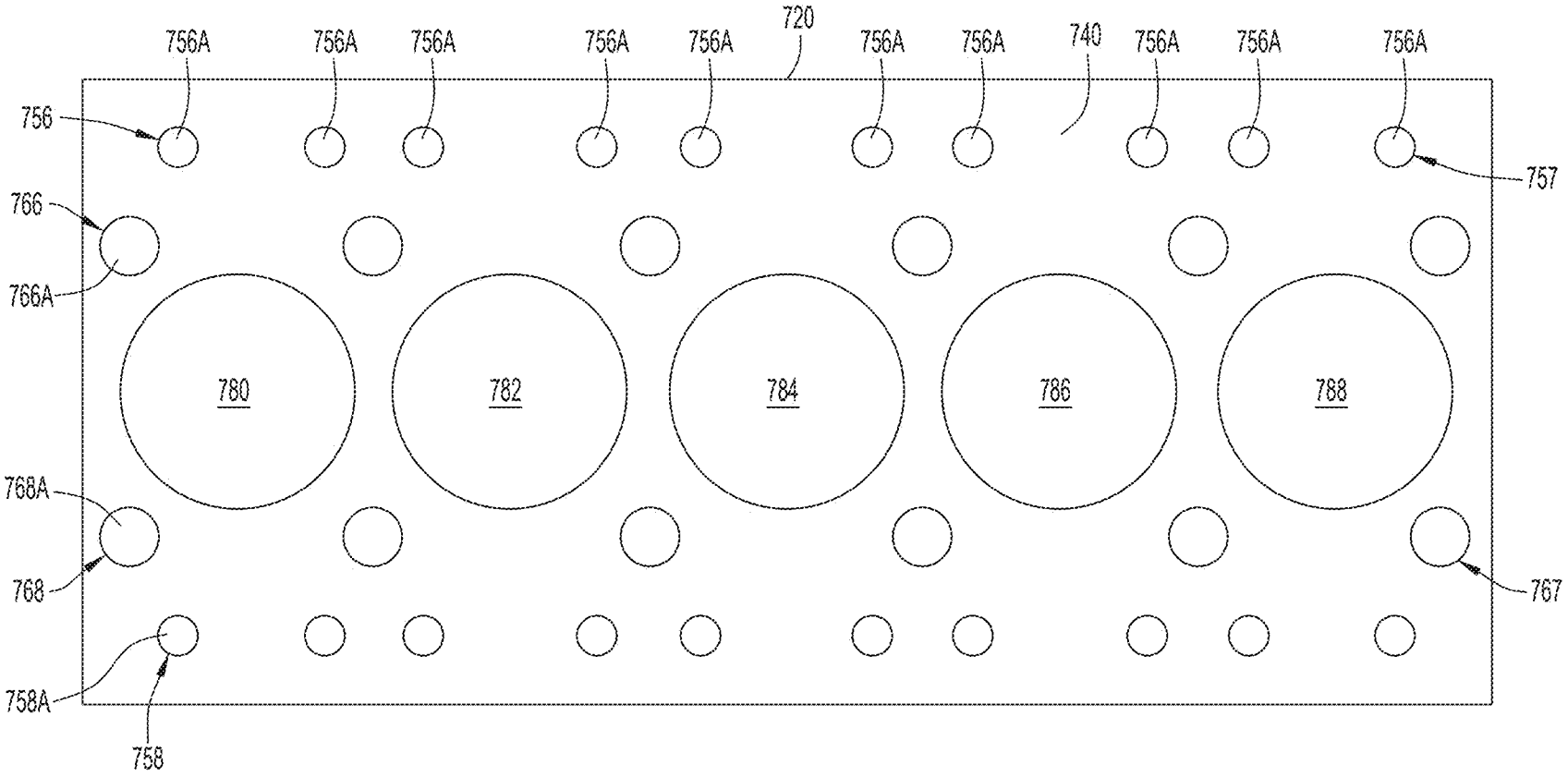
FIG. 10 is a front view showing the tie rod holes in the nose plate of the reciprocating pump illustrated in FIG. 5.

Referring to FIGS. 9 and 10, the relative positions of the openings in the nose plate 720 are illustrated. The first pattern 757 of coupler openings and the second pattern 767 of coupler openings are located around several reciprocating member holes 780, 782, 784, 786, and 788, which are configured to receive pony rods. The first pattern 757 of coupler openings includes a first row 756 and a second row 758. The first row 756 includes holes 756A that are spaced apart across the nose plate 720. The second row 758 includes holes 758A that are spaced apart across the nose plate 720. Similarly, the second pattern 767 of coupler openings includes a first row 766 and a second row 768. The first row 766 includes holes 766A that are spaced apart across the nose plate 720. The second row 768 includes holes 768A that are spaced apart across the nose plate 720. It is to be understood that in FIG. 10, while each of the holes 756A in row 756 are labeled, only one of each of holes 766A, 768A, and 758A in rows 766, 768, and 758, respectively, are labeled for simplicity only.

As best shown in FIG. 10, row 756 and row 758 are located closer to the top end and to the bottom end of the nose plate 720, respectively, than row 766 and row 768. This relative positioning of the rows can be referred to as row 756 and row 758 being exteriorly located relative to row 766 and row 768, or rows 766 and 768 being interiorly located relative to rows 756 and 758. In addition, each of the rows 756, 758, 766, and 758 is located outside or exteriorly of, or closer to the outer perimeter of the nose plate 720, than the reciprocating member holes 780, 782, 784, 786, and 788.

In one embodiment, the diameters of the holes 756A and 758A are different from the diameter of the holes 766A and 768A. In an alternative embodiment, the diameters of the holes 756A and 758A are the same as the diameter of the holes 766A and 768A. In different embodiments, the locations of the first pattern 757 of coupler holes and the second pattern 767 of coupler holes can vary.

In different embodiments, additional tie rod patterns are possible for the nose plate 720. The additional tie rod patterns can be different from the first pattern 750 and the second pattern 760 described above.

While the invention has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

Similarly, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Finally, when used herein, the term "comprises" and its derivations (such as "comprising", etc.) should not be understood in an excluding sense, that is, these terms should not be interpreted as excluding the possibility that what is described and defined may include further elements, steps, etc. Meanwhile, when used herein, the term "approximately" and terms of its family (such as "approximate," etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially."

What is claimed is:

1. A reciprocating pump, comprising:

a power end configured to generate pumping power, the power end including:

a frame; and a nose plate coupled to the frame, the nose plate including:

a first set of first openings formed therein, the first set of first openings being configured to receive a first set of couplers that can couple a first fluid end to the power end by coupling with a proximate face of the first fluid end; and a second set of second openings formed therein, the second set of second openings being configured to receive a second set of couplers that can couple a second fluid end to the power end by coupling with a distal face of the second fluid end, wherein the second fluid end is different from the first fluid end, and the first set of first openings is different than the second set of second openings.

2. The reciprocating pump of claim 1, wherein the first set of couplers are tie rods having a first length.

3. The reciprocating pump of claim 2, wherein the second set of couplers are tie rods having a second length, and the second length is different than the first length.

4. The reciprocating pump of claim 1, wherein the nose plate further comprises a third set of third openings configured to receive pony rods of the power end.

5. The reciprocating pump of claim 4, wherein the second set of second openings are disposed exteriorly of a space bounded by the third set of third openings.

6. The reciprocating pump of claim 5, wherein the first set of first openings are disposed exteriorly of a second space bounded by the second set of second openings.

7. The reciprocating pump of claim 1, wherein each of the first openings has a first diameter, and each of the second openings has a second diameter, the second diameter being larger than the first diameter.

8. The reciprocating pump of claim 1, wherein the first set of first openings is arranged in a first row across the nose plate and in a second row across the nose plate, the second set of second openings is arranged in a third row across the nose plate and in a fourth row across the nose plate.

9. The reciprocating pump of claim 8, wherein the first row and the second row are located exteriorly of a space bounded by the third row and the fourth row.

10. The reciprocating pump of claim 8, wherein each of the first openings and the second openings is a threaded opening.

11. A reciprocating pump, comprising:

a power end configured to generate pumping power, the power end including:

a frame that has a nose plate, the nose plate including:

a first set of first openings formed therein in a first pattern, the first set of first openings in the nose plate is configured to receive a first set of couplers that can couple a first fluid end to the power end by coupling with a proximate face of the first fluid end; and a second set of second openings formed therein in a second pattern, the first pattern being different from the second pattern, the second set of second openings in the nose plate is configured to receive a second set of couplers that can couple a second fluid end to the power end by coupling with a distal face of the second fluid end, wherein the second fluid end is different from the first fluid end.

12. The reciprocating pump of claim 11, wherein each of the first set of couplers and the second set of couplers is a tie rod.

13. The reciprocating pump of claim 11, wherein the nose plate includes a third set of third openings configured to receive pony rods of the power end.

14. The reciprocating pump of claim 13, wherein the first set of first openings are disposed exteriorly of a third space bounded by the third set of third openings, and the second set of second openings are disposed interiorly of a first space bounded by the first set of first openings.

15. The reciprocating pump of claim 11, wherein the first set of first openings is arranged in a first row and in a second row across the nose plate, the second set of second openings is arranged in a third row and in a fourth row across the nose plate, and the second openings are different from the first openings.

16. The reciprocating pump of claim 15, wherein the first row and the second row are located exteriorly of a space bounded by the third row and the fourth row.

17. The reciprocating pump of claim 11, wherein each of the first openings and the second openings is a threaded opening.

18. A power end for a reciprocating pump, comprising:

a frame having a nose plate that has a body, the body of the nose plate including:

a first set of first openings extending through the body of the nose plate and being disposed in a first pattern, the first set of first openings configured to receive first couplers that are configured to couple a first fluid end to the nose plate by coupling with a proximate face of the first fluid end; and a second set of second openings extending through the body of the nose plate and being disposed in a second pattern, the second set of second openings configured to receive second couplers that are configured to couple a second fluid end to the nose plate by coupling with a distal face of the second fluid end, wherein the second pattern is different from the first pattern, the second fluid end engages a different pattern of couplers than the first fluid end, and the second couplers are different than the first couplers.

19. The power end of claim 18, wherein the first set of first openings is arranged in a first row across the nose plate and in a second row across the nose plate, the second set of second openings is arranged in a third row across the nose plate and in a fourth row across the nose plate, and the second openings are different from the first openings.

20. The power end of claim 19, wherein the first row and the second row are located exteriorly of a space bounded by the third row and the fourth row.

* * * * *